US007337945B1

(12) United States Patent
Riggs et al.

(10) Patent No.: US 7,337,945 B1
(45) Date of Patent: Mar. 4, 2008

(54) MAILBOX DELIVERY INDICATOR APPARATUS

(76) Inventors: Robert W. Riggs, 3070 Leeridge Dr., Bartlett, TN (US) 38134; Donald Riggs, 3070 Leeridge Dr., Bartlett, TN (US) 38134

( * ) Notice: Subject to any disclaimer, the term of this patent is extended or adjusted under 35 U.S.C. 154(b) by 0 days.

(21) Appl. No.: 11/799,144

(22) Filed: May 1, 2007

(51) Int. Cl.
*A47G 29/12* (2006.01)

(52) U.S. Cl. ..... 232/35

(58) Field of Classification Search ..... 232/35, 232/17, 45
See application file for complete search history.

(56) References Cited

U.S. PATENT DOCUMENTS 2,754,051 A * 7/1956 Shellabarger ..... 232/35
3,017,073 A * 1/1962 Piergiovanni ..... 232/35
3,026,025 A * 3/1962 Hanson ..... 232/35
3,194,491 A * 7/1965 Parker ..... 232/35
3,318,516 A * 5/1967 Scheerer ..... 232/35
3,675,845 A * 7/1972 Scheerer ..... 232/35
3,891,139 A * 6/1975 Redling ..... 232/35
4,318,507 A * 3/1982 Thopsey et al. ..... 232/35
4,706,880 A * 11/1987 Peters ..... 232/35
5,927,596 A * 7/1999 Trenier ..... 232/35

* cited by examiner

*Primary Examiner*—William L. Miller
(74) *Attorney, Agent, or Firm*—Wyatt, Tarrant & Combs LLP; Sarah Osborn Hill

(57) ABSTRACT

The present invention relates to mailbox indicators. More specifically, the present invention relates to a mailbox delivery indicator apparatus with a signaling mechanism which is automatically triggered to deploy when the box is opened to indicate that the mail has been delivered.

11 Claims, 6 Drawing Sheets

MAILBOX DELIVERY INDICATOR APPARATUS

BACKGROUND OF THE INVENTION

The present invention relates to mailbox delivery indicators. More specifically, the present invention relates to a mailbox delivery indicator apparatus with a signaling mechanism which is automatically triggered to deploy when the box is opened to indicate that the mail has been delivered.

Individuals with mailboxes located away from the house may make multiple trips to the mailbox each day to determine if the mail has arrived. The present invention allows an individual to view his mailbox from a distance such as in his home and determine if the mail has arrived. This is useful for the elderly who may find multiple trips to the mailbox taxing. It is also helpful to reduce the chance that a person may injure themselves on a trip to the mailbox. It is useful in inclement weather when trips to the mailbox are undesirable. It is also useful when an individual's mailbox is located some distance from his house. The present invention also reduces the chance that an individual's mail will be stolen because it alerts her that the mail is available immediately after delivery.

There are other mailbox indicators in the art, but the present invention is an improvement over the prior art. One benefit of the present invention is that it has few moving parts. Another benefit of the present invention is that the mailbox can be made of any material and the mailbox delivery indicator will still function. For example, the mailbox can be made of either a magnetic or a non-magnetic material. Yet another benefit of the present invention is that it does not rely solely on gravity to deploy the flag indicating that the mail has arrived. The present invention is simple, easy to use and can be readily incorporated onto existing mailbox designs.

BRIEF SUMMARY OF THE INVENTION

The present invention discloses a mailbox delivery indicator apparatus with a signaling mechanism automatically triggered when the mail is delivered. Most of the mailbox delivery indicator apparatus is enclosed inside the mailbox. The invention comprises a mailbox with a flag with a raised position and a lowered position indicating delivery. The bottom of the flag is attached to the back side of the mailbox at a pivot point. When the flag is in the raised position, it is secured in place by a magnet attached to the top of the flag which is attracted to the back side of the mailbox. The flag covers a hole in the back side of the mailbox in the raised position.

A guide tube which runs from the front opening of the mailbox to the back side of the mailbox is attached to the interior of the mailbox. A rod is disposed inside the guide tube and capable of longitudinal movement therein. The rod runs from the opening of the mailbox to the back side of the mailbox. The rod is longer than the guide tube. An extension spring is attached to the first end of the rod and the first end of the guide tube. The mailbox has a door attached to the bottom of the mailbox for covering the front opening. A magnet is attached to the interior of the door. The magnet, the guide tube, rod, and the hole are all aligned. When the door is closed, the magnet engages the rod due to magnetic attraction.

When the door is opened for mail delivery, the rod is pulled out of the guide tube. This lengthens the spring, placing a load on the spring which stores this energy. When the spring reaches its maximum load, the magnetic connection is broken and the stored energy is released propelling the rod through the guide tube and hole. The released rod impacts the flag breaking the connection between the magnet on the flag and the back side and forcing the flag to swing about its pivot point into the lowered position thus indicating that the mail has been delivered. The user must simply place the flag back in the raised position by connecting the magnet on the flag to the back side to reset the mailbox indicator.

DETAILED DESCRIPTION OF THE INVENTION

Figure 1:
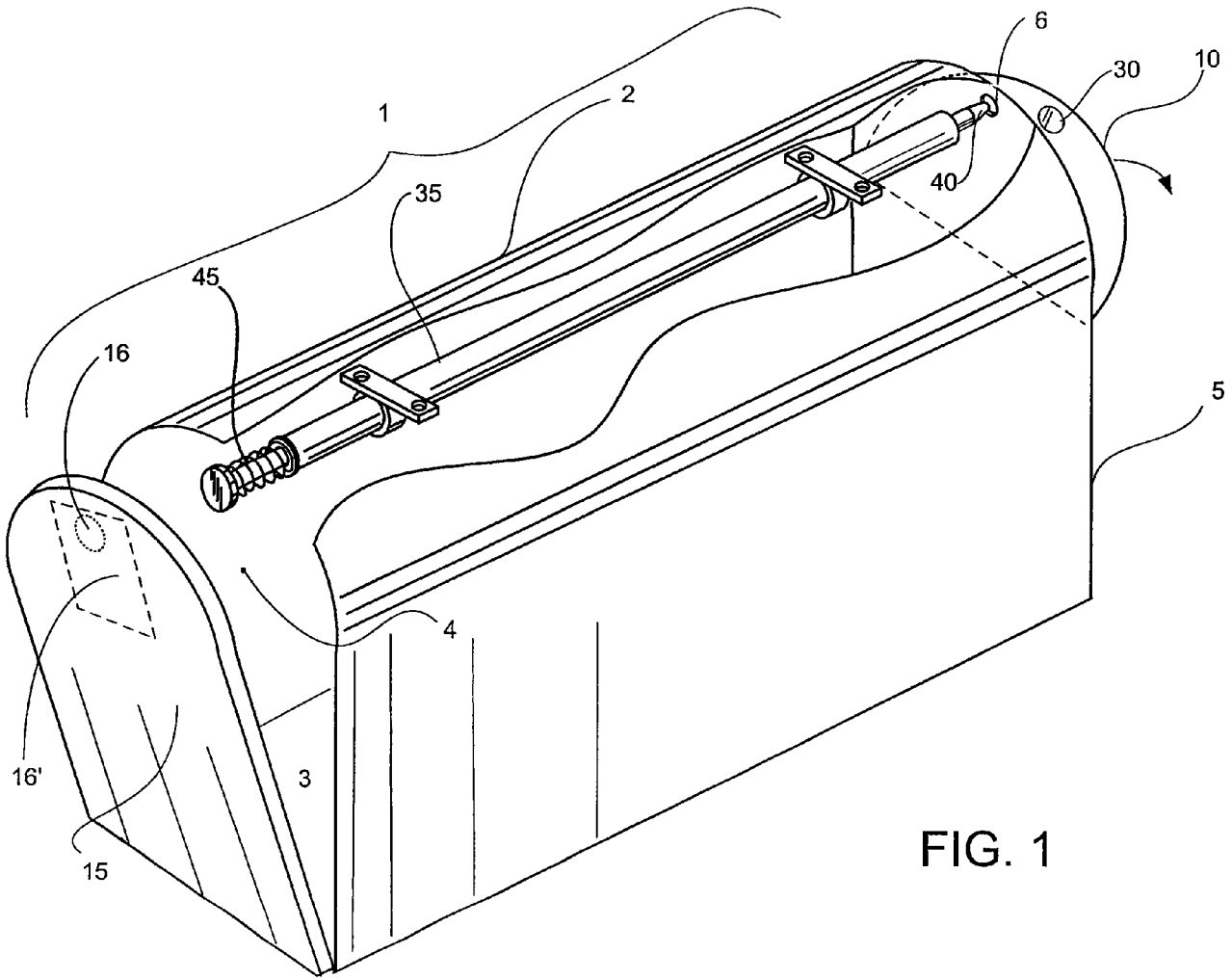
FIG. 1 is a perspective view of the mailbox delivery indicator apparatus.
Figure 2:
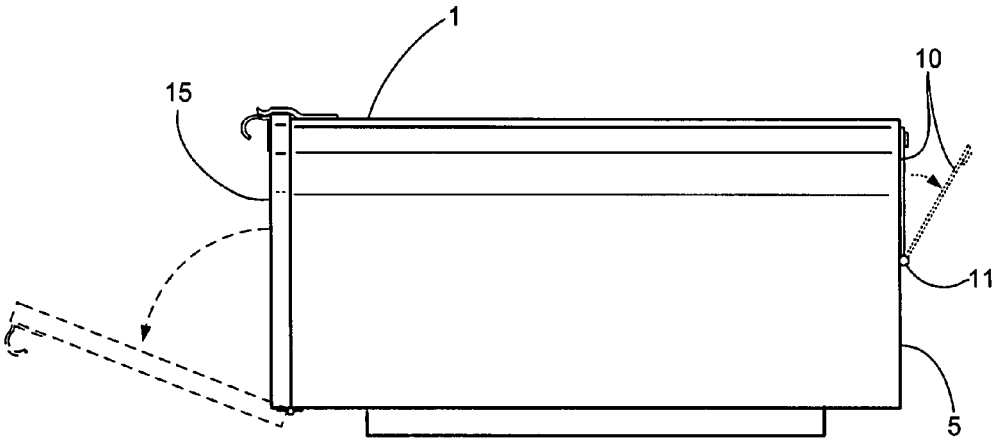
FIG. 2 is a side view of the mailbox delivery indicator apparatus.

Referring now to FIG. 1, the present invention comprises a mailbox 1 with a top 2, a bottom 3, a front opening 4 and a back side 5. A hole 6 extends through said back side 5. The mailbox 1 is made of any material suitable for withstanding the outdoor elements such as metal, wood, plastic or the like. Both magnetic and non-magnetic materials are suitable. A door 15 for covering said front opening 4 is attached to said bottom 3 of said mailbox 1. The door 15 is attached to the bottom 3 of said mailbox 1 by any number of methods, for example with a hinge, rivets, screws, and the like. Those skilled in the art will recognize that there are many other methods of attachment that are acceptable. A magnet 16 is attached to the interior of the door 15 such that it is aligned with the hole 6 in said back side 5.

The magnet 16 can be any type of magnet. In one embodiment, the magnet 16 is a ferrous magnet. In an alternative embodiment, magnet 16 is a rare earth magnet such as a neodymium magnet, samarium-cobalt magnet, or any other rare earth magnet. Rare earth magnets are strong, permanent magnets made from alloys of rare earth elements. Rare earth magnets are substantially stronger than ferrous magnets. Magnetic fields produced by rare earth magnets can be in excess of 1.2 teslas. Ferrous magnets typically exhibit magnetic fields of 50 to 100 milliteslas. Neodymium magnets, made of neodymium, iron and boron, are the most powerful and affordable type of rare earth magnet. Samarium-cobalt magnets are less common, more expensive, and not as strong and neodymium magnets, but are well suited for high temperature applications. Those skilled in the art will recognize that any type of magnet can be used with the present invention and there are many factors which govern the selection of the type of magnet.

Figure 3:
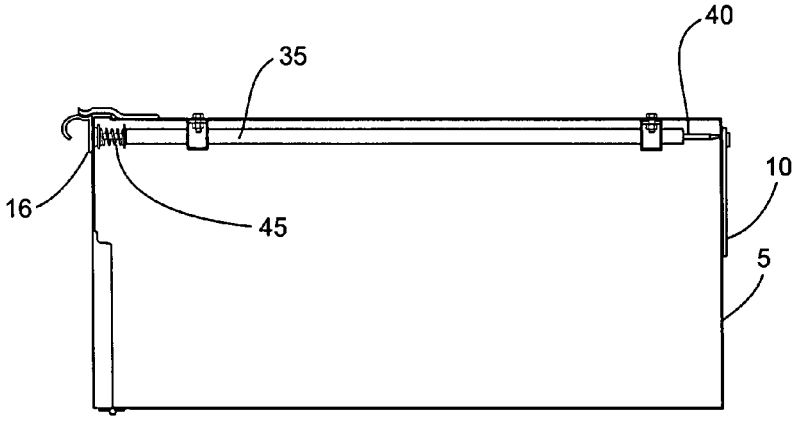
FIG. 3 is a side view of the mailbox delivery indicator apparatus.
Figure 4:
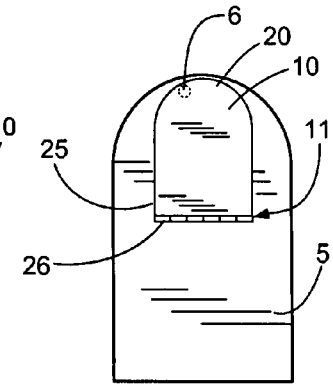
FIG. 4 is a back view of the mailbox delivery indicator apparatus with the flag in the raised position.

Referring now to FIG. 4, the present invention includes a flag 10 for signaling mail delivery. The flag 10 has a top 20 and a bottom 25. The bottom 25 of flag 10 is affixed to said back side 5 of said mailbox 1 at a pivot point 11. It may be affixed with a hinge, a bolt, or other similar fastener 26 which allows the flag 10 to swing about the pivot point 11. The flag 10 has a raised position (FIGS. 3, 4, 10, 11 and 12) and a lowered position (FIGS. 8, 9, 13 and 14).

Figure 10:
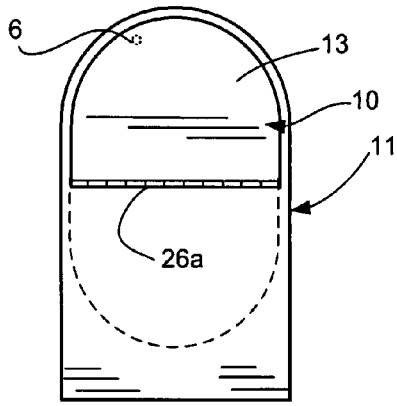
FIG. 10 is a back view of the mailbox delivery indicator apparatus with the flag in the raised position.
Figure 14:
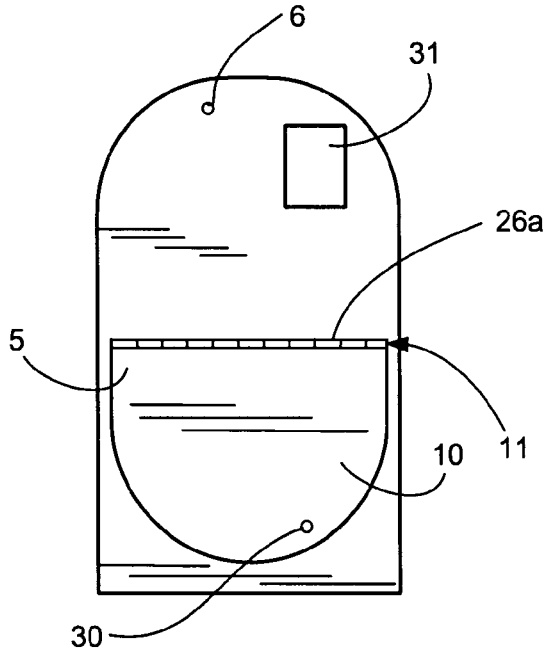
FIG. 14 is a back view of the mailbox delivery indicator apparatus with the flag in the lowered position and a magnetic plate affixed to the back of the mailbox.

In another embodiment, the front 12 is a contrasting color to the back 13. The back 13 is the same color as the mailbox 1. The flag 10 is affixed to the back side 5 such that it covers the hole 6 when it is in the raised position (FIGS. 4 and 10). A magnet 30 is affixed to the top 20 of the flag 10. The flag 10 has a front 12 and a back 13. The top 20 of the flag 10 is attached to the back side 5 via magnetic attraction between the magnet 30 and said back side 5. In an embodiment where mailbox 1 is not made of a magnetic material, a magnetic plate 31 is affixed to said back side 5 (FIG. 14). In an alternative embodiment, the magnet 30 is attached to the back side and the flag 10 is magnetic.

In one embodiment, the magnet 30 is a ferrous magnet. In an alternative embodiment, magnet 30 is a rare earth magnet such as a neodymium magnet, samarium-cobalt magnet, or any other rare earth magnet. Those skilled in the art will recognize that any type of magnet can be used with the present invention and there are many factors which govern the selection of the type of magnet.

Figure 5:
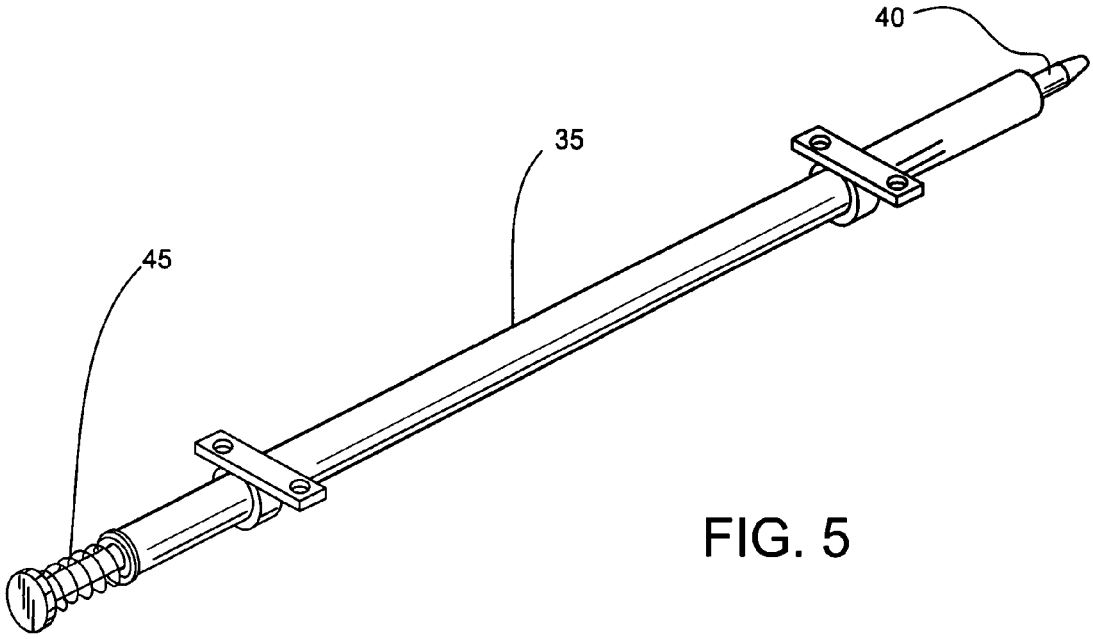
FIG. 5 is a perspective view of the rod, guide tube, and spring assembly of the mailbox delivery indicator apparatus.

Referring now to FIGS. 1, 3 and 5, a hollow guide tube 35 of a certain length extends from said front opening 4 to said back side 5. Guide tube 35 is made of any durable, corrosion resistant material such as metal, plastic, or the like. Guide tube 35 is affixed to the interior of said mailbox 1. Guide tube 35 is aligned with said hole 6 and said magnet 16 on said door 15. A rod 40 is disposed inside said guide tube 35 such that it can move longitudinally inside said guide tube 35. Rod 40 is longer than said guide tube 35, but fits within the interior of said mailbox 1. A first end of rod 40 is in contact with magnet 16 when said door 15 is closed. A second end of rod 40 is capable of extending through said hole 6. When said rod 40 extends through said hole 6 and said flag 10 is in the raised position, said rod 40 is in contact with said flag 10. The rod 40 may be made of any durable, corrosion resistant material capable of being attracted by a magnet. In an alternative embodiment, the magnet 16 is attached to said first end of said rod 40 and the door 15 is magnetic. In yet another embodiment, the magnet 16 is attached to said first end of said rod 40 and magnetic plate 16' is attached to door 15. In another alternative embodiment, the magnet 16 is attached to the door 15 and the rod 40 is made of any durable, corrosion resistant material and a magnetic tip (not shown) is affixed to the first end of said rod 40.

One benefit of the present invention is that the rod 40 is enclosed inside guide tube 35. When the mailbox 1 is full of mail, the movement of the rod 40 is not impeded by the mail.

An extension spring 45 surrounds said first end of said rod 40 and extends from said first end of said rod 40 to said guide tube 35. An extension or tension spring is designed to become longer under load. Either end of an extension spring is attached to an item. When a load is placed on the spring by moving the items apart, the extension spring resists the load and stores the energy created by that force. When the load is released, the energy is also released and the extension spring comes back to its original length. In the present invention, a first end of spring 45 is attached to said first end of rod 40 and a second end of spring 45 is attached to said guide tube 35.

Figure 6:
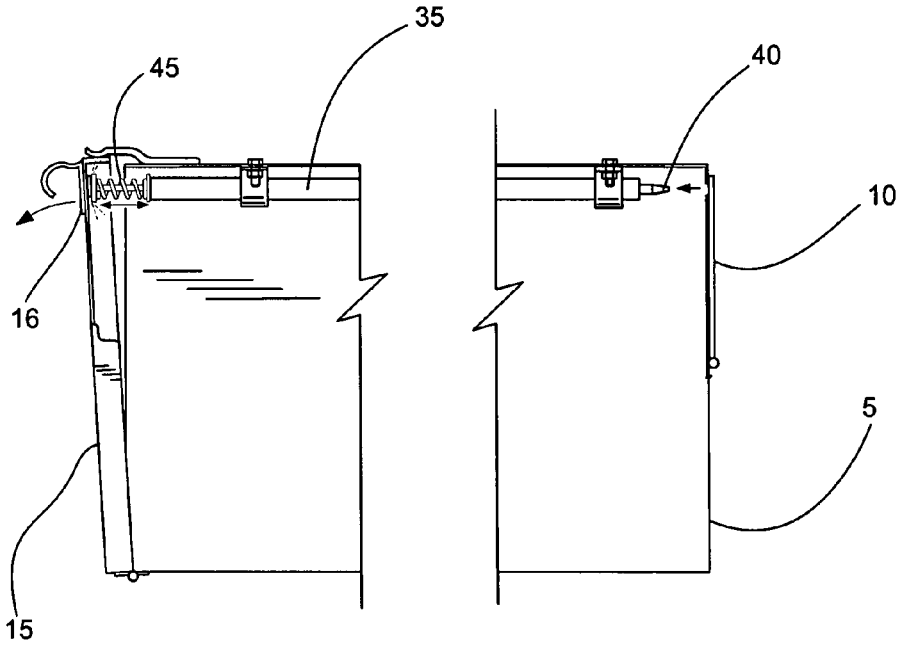
FIG. 6 is a side view of the mailbox delivery indicator apparatus with the flag in the raised position showing longitudinal movement of the rod when the mailbox door is opened.
Figure 7:
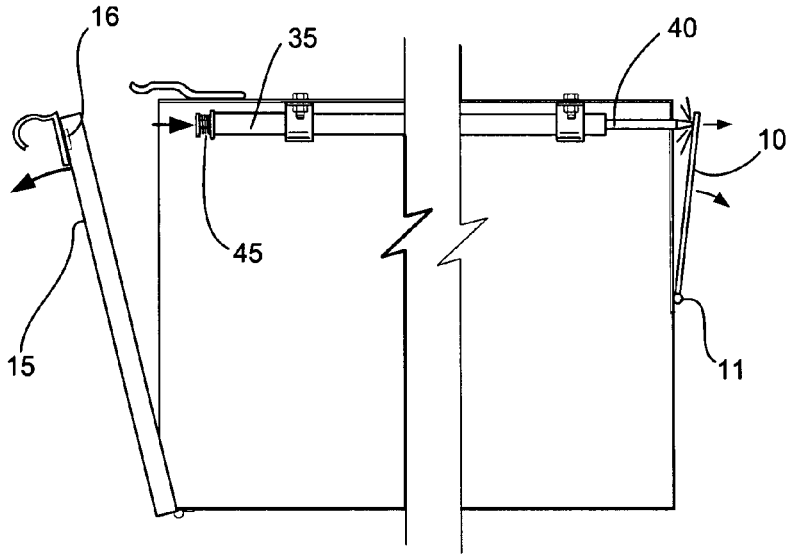
FIG. 7 is a side view of the mailbox delivery indicator apparatus showing the rod contacting the flag and knocking it into the lowered position when the mailbox door is opened.
Figure 8:
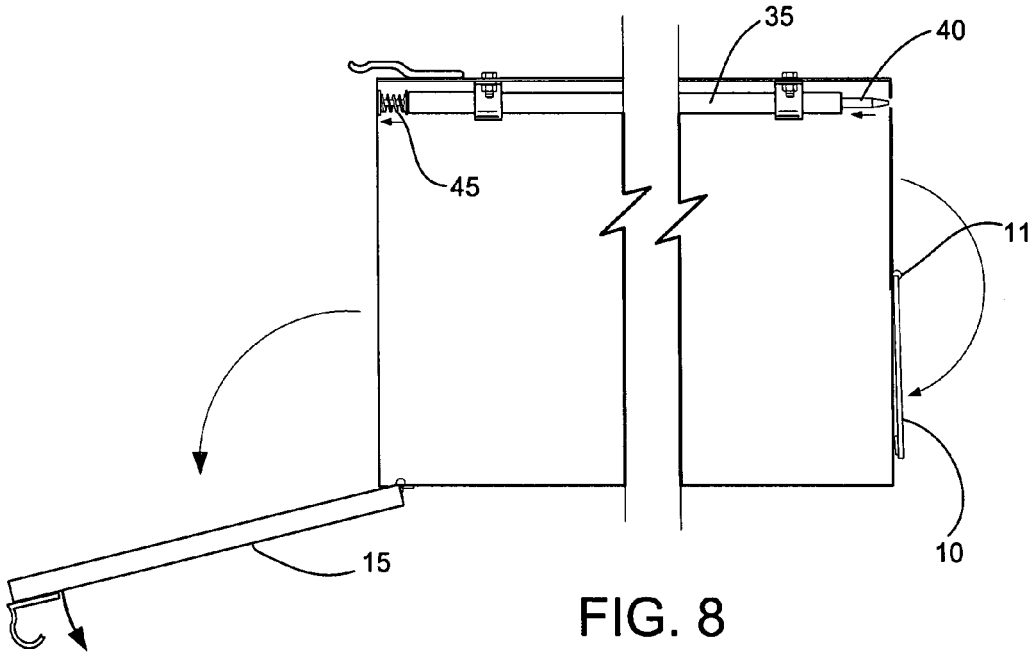
FIG. 8 is a side view of the mailbox delivery indicator apparatus showing the mailbox door opened and the flag in the lowered position.
Figure 9:
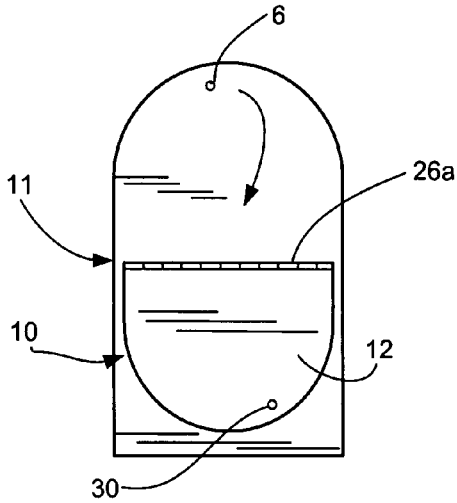
FIG. 9 is a back view of the mailbox delivery indicator apparatus with the flag in the lowered position.

When door 15 is closed, the first end of rod 40 is attached to magnet 16 due to the magnetic attraction between rod 40 and magnet 16 (FIG. 3). Referring now to FIG. 6, when door 15 is opened, rod 40 remains attached to magnet 16 due to this magnetic attraction. As the door 15 opens, rod 40 is pulled out of guide tube 35 toward door 15. This movement lengthens spring 45, placing an increasing load on said spring 45. Referring now to FIG. 7, the connection between rod 40 and magnet 16 is broken when the spring 45 reaches its maximum load. The door 15 continues to open, but when the maximum load is reached, spring 45 holds rod 40 in place and the magnetic connection between rod 40 and magnet 16 is broken. When the contact between magnet 16 and rod 40 is broken, the energy stored in spring 45 is released, and rod 40 is propelled towards back side 5, through guide tube 35 and hole 6 where it impacts flag 10, breaking the connection between magnet 30 and back side 5 and pushing flag 10 into the lowered position (FIG. 8).

In one embodiment, the fastener **26*a* is a hinge which is attached to the bottom of the flag 10 and affixed to back side 5 at pivot point 11. (FIGS. 9, 10, and 14) Said hinge 26*a* having a horizontal axis running parallel to said back side 5. Flag 10 swings forward about the horizontal axis at pivot point 11. When in the lowered position, the flag 10 covers the entire back side 5 of the mailbox 1. In this embodiment, the front 12 of the flag 10 is a contrasting color to the back 13 of flag 10. The back 13 is the same color as the mailbox 1. Thus when the flag 10 is in the lowered position, the front 12** is displayed outwardly, and a contrasting color is visible from a distance indicating that the mail has been delivered.

In another embodiment, as shown in FIG. 4, flag 10 covers a large portion of the back side 5 of the mailbox 1 when in the lowered position. The fastener **26*a* is a hinge which is attached to the bottom of the flag 10 and affixed to back side 5 at pivot point 11. The front 12 of the flag 10 is a contrasting color to the back 13 of flag 10. The back 13 is the same color as mailbox 1. Thus when the flag 10 is in the lowered position, the front 12** is displayed outwardly and a contrasting color is visible from a distance indicating that the mail has been delivered.

Figure 11:
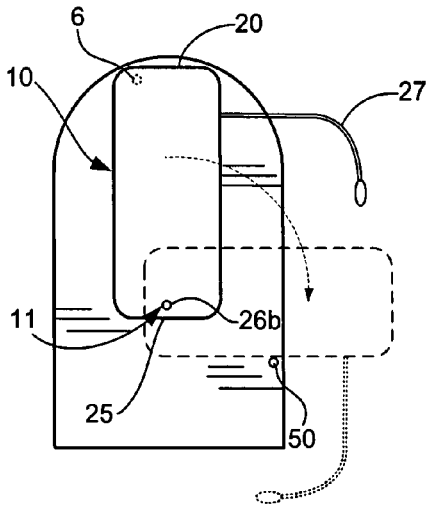
FIG. 11 is a back view of the mailbox delivery indicator apparatus with the flag in the raised position where the guide means attached to the flag is a weight.
Figure 12:
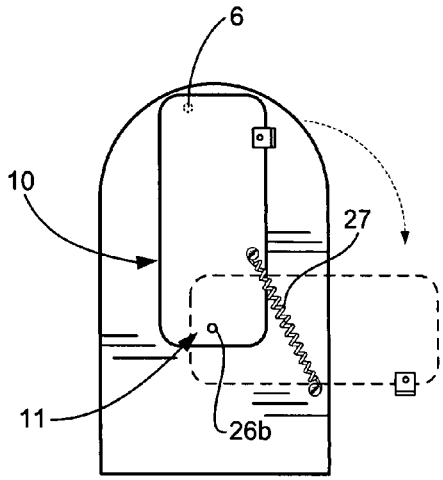
FIG. 12 is a back view of the mailbox delivery indicator apparatus with the flag in the raised position where the guide means attached to the flag is an extension spring.
Figure 13:
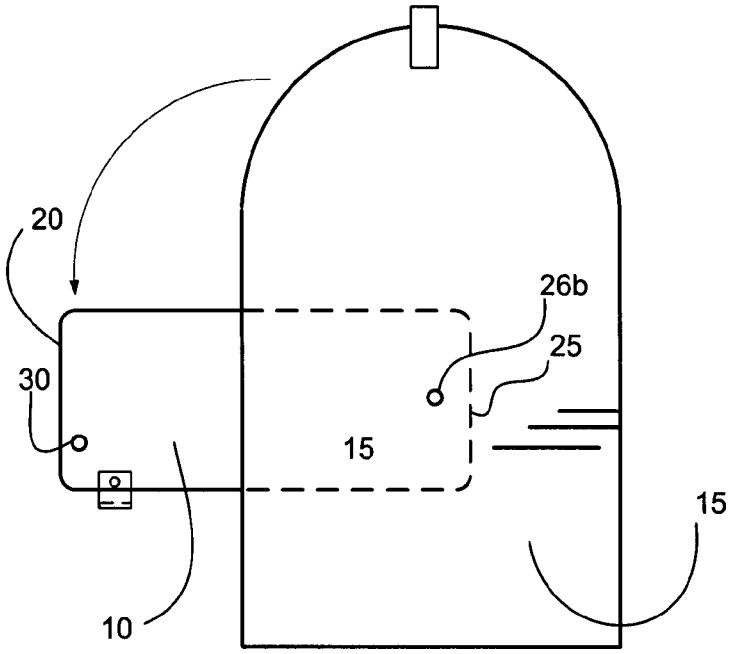
FIG. 13 is a front view of the mailbox delivery indicator apparatus with the flag in the lowered position.

In yet another embodiment, as shown in FIGS. 11, 12, and 13, the bottom 25 of flag 10 is attached to back side 5 with fastener **26*b* creating pivot point 11. In this embodiment, the fastener 26*b* is a bolt, rivet or the like, having an axis running through the center of fastener 26*b* and extending perpendicular to back side 5 at pivot point 11. Flag 10 is capable of swinging from side to side about said axis at pivot point 11. An edge at the top 20 of flag 10 adjacent to hole 6 is beveled. When the flag 10 is in the raised position and the rod 40 impacts the flag 10 braking the connection between the back side 5 and magnet, the beveled edge forces the flag 10 sideways. A guide means 27 is attached to a side of flag 10 near top 20. The guide means 27 is an extension spring (FIG. 12), a cable, a weight (FIG. 11) or the like. Referring now to FIG. 11, where the guide means 27 is an extension spring or a cable, there is a load on the guide means 27 when the flag 10 is in the raised position. When the flag 10 is in the raised position and rod 40 impacts the flag 10 breaking the connection between the back side 5 and the magnet 30, the load is released and the guide means 27 pulls the flag 10 into the lowered position. Referring now to FIG. 10, where the guide means 27 is a weight, the guide means 27 is attached to a side of flag 10 near the top 20. When the flag 10 is in the raised position and the rod 40 impacts the flag 10 breaking the connection between the back side 5 and the magnet 30, the guide means 27 pulls the flag 10 into the lowered position. A stop nut 50 is attached to said back side 5. Flag 10 pivots about said pivot point 11 until said flag 10 contacts said stop nut 50**.

In this embodiment, when the flag 10 is in the lowered position it can be seen from the front (FIG. 13) and the rear of the mailbox 1. The front 12 and the back 13 of the flag 10 are a contrasting color to the mailbox. An added benefit of this embodiment is that it can be used with a mailbox 1 that has a post or ornamental object covering the back side 5. Another benefit is that the mailbox can be placed across the street from the home and the flag 10 can be seen from the front of the mailbox 1.

To reset the mailbox delivery indicator apparatus, the user retrieves his mail. He then swings the flag 10 about the pivot point 11 into the raised position. He attaches the flag 10 to the back side 5 by connection the magnet 30 to said back side 5.

What is claimed is:

1. A mailbox delivery indicator apparatus comprising:

a mailbox having an interior surface and an exterior surface, said mailbox having a front opening, a back side, a top and a bottom, said back side having a hole extending there through;

a flag for signaling delivery having a top and a bottom, said bottom of said flag affixed to the exterior of said back side of said mailbox at a pivot point such that said flag swings about said pivot point, said flag having a raised position for covering said hole in said back side and a lowered position for signaling delivery;

a first magnet affixed to said flag securing said top of said flag to said exterior of said back side of said mailbox such that said flag covers said hole in said raised position;

a door for covering said front opening attached to said bottom of said mailbox with a front and a back, said back of said door facing the interior surface of said mailbox when said door is closed, said back of said door having a second magnet affixed to said door and aligned with said hole in said back side of said mailbox;

a guide tube of a predetermined length having a first end and a second end, said first end of said guide tube adjacent to said front opening of said mailbox, said guide tube extending to said back side of said mailbox, said guide tube enclosed in said mailbox and affixed to said interior surface of said mailbox, said guide tube aligned with said second magnet and said hole;

a rod disposed inside said guide tube for longitudinal movement within said guide tube, said rod of a predetermined length greater than said guide tube and enclosed within said guide tube, a first end of said rod engaged by said second magnet, a second end of said rod for impacting said top of said flag by extending through said hole in said back side of said mailbox thus forcing said flag into the lowered position; and an extension spring for storing energy when said door is opened and said rod is pulled due to the magnetic connection of said rod and said second magnet and thrusting said rod through said hole by releasing stored energy when the connection between said rod and said second magnet is broken, said spring surrounding said first end of said rod, a first end of said spring attached to said rod, a second end of said spring attached to said first end of said guide tube.

2. The mailbox delivery indicator apparatus of claim 1 where:

said bottom of said flag is affixed to said exterior of said back side of said mailbox with a hinge such that said flag may pivot around said hinge when said top of said flag is unattached.

3. The mailbox delivery indicator apparatus of claim 1 where:

said bottom of said flag is affixed to said exterior of said back side of said mailbox with a fastener such that said flag may pivot around said fastener when said top of said flag is unattached;

said top of said flag has a beveled edge which covers said hole; and a stop attached to said back side for stopping said flag from pivoting.

4. The mailbox delivery indicator apparatus of claim 3 further comprising:

a weight attached to said top of said flag.

5. The mailbox indicator apparatus of claim 3 further comprising:

a second extension spring loaded when said flag is in said raised position for pulling said flag to said lowered position by releasing stored energy when said flag is detached from said first magnet, said second spring having a first end and a second end, said first end of said second spring attached to said flag; and said second end of said second spring attached to said back side of said mailbox.

6. The mailbox delivery indicator apparatus of claim 1 where:

said first and second magnets are rare earth magnets.

7. The mailbox delivery indicator apparatus of claim 1 where:

said flag is a contrasting color to said mailbox.

8. The mailbox indicator apparatus of claim 1 where:

a front of said flag is a contrasting color to said mailbox; and a back of said flag is the same color as said mailbox.

9. A mailbox delivery indicator apparatus comprising:

a mailbox having an interior surface and an exterior surface, said mailbox having a front opening, a back side, a top and a bottom, said back side having a hole extending there through;

a flag for signaling delivery having a top and a bottom, said bottom of said flag affixed to the exterior of said back side of said mailbox at a pivot point such that said flag swings about said pivot point, said flag having a raised position for covering said hole in said back side and a lowered position for signaling delivery;

a first magnet affixed to said flag securing said top of said flag to said exterior of said back side of said mailbox such that said flag covers said hole in said raised position;

a door for covering said front opening attached to said bottom of said mailbox with a front and a back, said back of said door facing the interior surface of said mailbox when said door is closed, said door being magnetic;

a guide tube of a predetermined length having a first end and a second end, said first end of said guide tube adjacent to said front opening of said mailbox, said guide tube extending to said back side of said mailbox, said guide tube enclosed in said mailbox and affixed to said interior surface of said mailbox;

a rod disposed inside said guide tube for longitudinal movement within said guide tube, said rod of a predetermined length greater than said guide tube and enclosed within said guide tube, a second magnet affixed to a first end of said rod, a second end of said rod for impacting said top of said flag by extending through said hole in said back side of said mailbox thus forcing said flag into the lowered position; and an extension spring for storing energy when said door is opened and said rod is pulled due to the magnetic connection of said door and said second magnet and thrusting said rod through said hole by releasing stored energy when the connection between said door and said second magnet is broken, said spring surrounding said first end of said rod, a first end of said spring attached to said rod, a second end of said spring attached to said first end of said guide tube.

10. The mailbox delivery indicator apparatus of claim 9 where:

said door being magnetic via a magnetic plate affixed to said door.

11. A mailbox delivery indicator apparatus comprising:

a mailbox having an interior surface and an exterior surface, said mailbox having a front opening, a back side, a top and a bottom, said back side having a hole extending there through;

a flag for signaling delivery having a top and a bottom, said bottom of said flag affixed to the exterior of said back side of said mailbox at a pivot point such that said flag swings about said pivot point, said flag having a raised position for covering said hole in said back side and a lowered position for signaling delivery, said flag being magnetic;

a first magnet affixed to said back side of said mailbox securing said flag to said exterior surface of said back side of said mailbox such that said flag covers said hole in said raised position;

a door for covering said front opening attached to said bottom of said mailbox with a front and a back, said back of said door facing the interior surface of said mailbox when said door is closed, said back of said door having a second magnet affixed to said door and aligned with said hole in said back side of said mailbox;

a guide tube of a predetermined length having a first end and a second end, said first end of said guide tube adjacent to said front opening of said mailbox, said guide tube extending to said back side of said mailbox, said guide tube enclosed in said mailbox and affixed to said interior surface of said mailbox, said guide tube aligned with said second magnet and said hole;

a rod disposed inside said guide tube for longitudinal movement within said guide tube, said rod of a predetermined length greater than said guide tube and enclosed within said guide tube, a first end of said rod engaged by said second magnet, a second end of said rod for impacting said top of said flag by extending through said hole in said back side of said mailbox thus forcing said flag into the lowered position;

and an extension spring for storing energy when said door is opened and said rod is pulled due to the magnetic connection of said rod and said second magnet and thrusting said rod through said hole by releasing stored energy when the connection between said rod and said second magnet is broken, said spring surrounding said first end of said rod, a first end of said spring attached to said rod, a second end of said spring attached to said first end of said guide tube.

* * * * *